United States Patent [19]

Kimura et al.

[11] Patent Number: 4,986,676

[45] Date of Patent: Jan. 22, 1991

[54] PRINTING HEAD OF THE IMPACT TYPE

[75] Inventors: Koichi Kimura; Takeshi Matsumoto; Fumio Otsuka, all of Tokyo, Japan

[73] Assignee: Seikosha Co., Ltd., Tokyo, Japan

[21] Appl. No.: 387,674

[22] Filed: Jul. 31, 1989

[30] Foreign Application Priority Data

Jul. 29, 1988 [JP] Japan ..... 63-189864

[51] Int. Cl.[5] ..... B41J 2/235; B41J 2/25

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,230,038 | 10/1980 | Hebert | 400/124 |
| 4,661,002 | 4/1987 | Ara | 400/124 |
| 4,822,187 | 4/1989 | Gugel | 400/124 |
| 4,832,515 | 5/1989 | Kawakami | 400/124 |
| 4,886,381 | 12/1989 | Kersey | 400/124 |

FOREIGN PATENT DOCUMENTS

| | | | |
|---|---|---|---|
| 61577 | 4/1982 | Japan | 400/124 |
| 141568 | 7/1985 | Japan | 400/124 |

*Primary Examiner*—Edgar S. Burr
*Assistant Examiner*—Joseph R. Keating
*Attorney, Agent, or Firm*—Jordan and Hamburg

[57] ABSTRACT

A printing head includes a plurality of printing levers, each having a front end portion and a rear end portion, with each printing lever being rotatable about its rear end portion. An electromagnetic drive is operable to individually drive the printing levers in a driving direction so as to apply a printing force to printing elements operated by the printing levers. Resilient springs operatively associated with the printing levers resiliently apply a return force to each of the printing levers in a return direction opposite to the driving direction. Stopper devices are disposed to be operatively engaged by each of the printing levers upon application of the printing force to thereby preclude contact between each of the printing levers and the electromagnetic drives upon application of the printing force.

6 Claims, 5 Drawing Sheets

PRINTING HEAD OF THE IMPACT TYPE

BACKGROUND OF THE INVENTION

The present invention relates to an impact-type printing head.

A conventional printing head of the so-called clapper type is provided with a plurality of printing levers in correspondence with a plurality of printing elements and a plurality of electromagnetic driving devices for driving the respective printing levers. Each of the printing heads is also provided with a return spring comprising a coil spring or a plate spring for returning each of the printing elements. Each of the printing elements is advanced for printing by a corresponding electromagnetic driving device and then retracted to a standby position.

In the above-mentioned prior art, each of the printing levers is rotated by applying a current to the coil of each of the electromagnetic driving devices until the movable yoke portion of the corresponding printing lever becomes attracted by and adheres to the core element of each electromagnetic driving device. After printing has been effected by each printing element, each printing lever is retracted by a spring force stored in the return spring. However, since each of the movable yoke portions adheres to the corresponding core element, a large recovery force is require to separate them, and it takes a large force for each printing lever to move backwardly against the force of attraction. It is also very difficult to exert a constant attractive force on all the printing levers because of such influences as production errors and so on, and thus it is very difficult to equalize the respective times required for backwardly moving all the printing levers, resulting in discrepancies in movement characteristics between the respective printing levers.

It is an object of the present invention to eliminate the state in which the movable yoke portion of each of the printing levers adheres to the corresponding core element and to ensure that each of the printing levers is rapidly returned with a small return force, as well as enabling the reduction of differences between the movements of the respective printing levers so as to obtain a relatively uniform return motion.

SUMMARY OF THE INVENTION

In order to achieve the above-described object, a printing head of the present invention comprises a plurality of printing levers which are rotatable around their respective rear end portions, each rear end portion serving as a supporting point and each lever functioning to drive a printing element at its front end portion; a plurality of electromagnetic driving devices which function to individually drive the respective printing levers so as to apply a printing energy to the printing elements; a return spring for applying a return force to each of the printing levers; and a stopper means with which a part of each of the printing levers comes into contact before each movable yoke portion thereof strikes against the respective core element of each of the electromagnetic driving devices when each of the printing levers is driven.

The stopper means is integrally provided in a yoke plate having grooves in which the lever rear end portions, each serving as a supporting point for each of the printing levers, are inserted and having elongated grooves in which the movable yoke portions of the printing levers are inserted.

Alternatively, the stopper portion is fixed to a yoke plate having grooves in which the rear end portions each serving as a supporting point of each of the printing levers are inserted and apertures in which the movable yoke portions of the printing levers are inserted.

In a printing operation, a part of each of the printing levers comes into contact with the stopper means before the movable yoke portion of each of the printing levers strikes against the corresponding core element. This arrangement avoids the abovementioned problem wherein, if each movable yoke portion contacts and adheres to the corresponding core element, the core elements strongly attract the respective movable yoke portions which thus cannot be easily separated therefrom and moved for returning. Each of the printing levers is thus caused to contact the stopper means before it adheres to a core element so as to be easily separated therefrom during the return.

An embodiment of the present invention will be described below with reference to the accompanying drawings.

BRIEF DESCRIPTION OF THE DRAWINGS

FIGS. 1 to 4 illustrate an embodiment of the present invention in which:

FIG. 1 is a sectional view of a principal portion;

FIG. 2 is a front view of a yoke plate in which a stopper portion is formed;

FIG. 3 is a front view of a stopper plate; and

FIG. 4 is a front view of a yoke plate.

FIGS. 5 to 7 illustrate another embodiment of the present invention, in which:

FIG. 5 is a sectional view of a principal portion;

FIG. 6 is a partially cut-away front view of a yoke plate to which a stopper plate is coupled; and FIG. 7 is a partially cut-away front view of a stopper plate.

DESCRIPTION OF THE PREFERRED EMBODIMENTS

Figure 1:
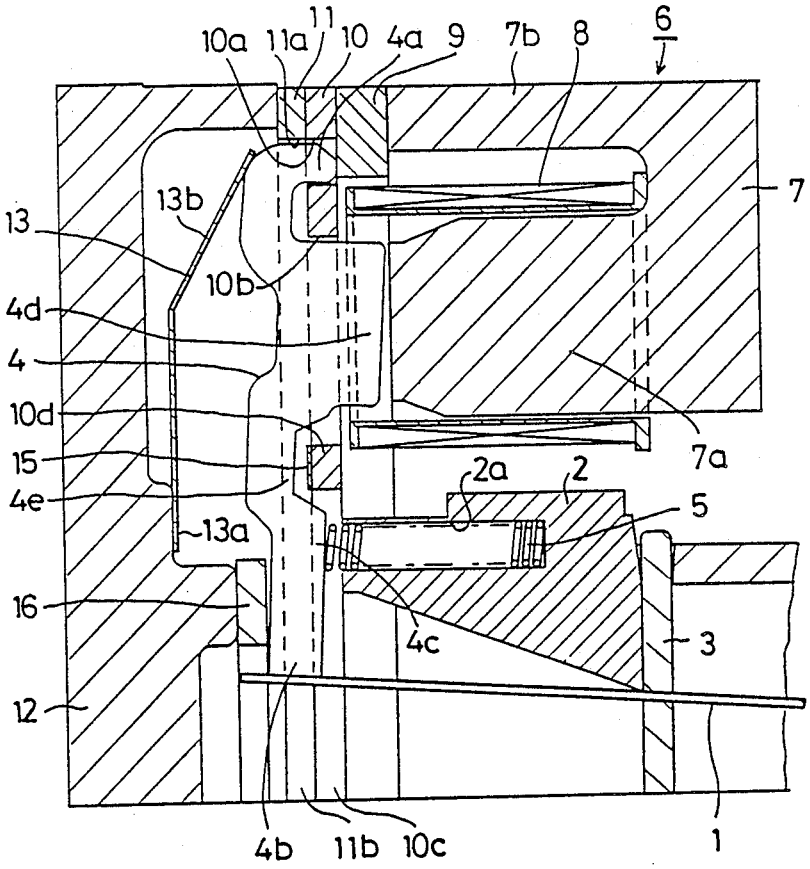

As shown in FIG. 1, a printing wire 1 serving as a printing element slidably passes through a wire guide 3 which is held by a guide support frame 2 made of a plastic material in practice, a plurality of printing wires 1 are of course provided and supported by a plurality of wire guides. The rear end portion of each of the printing wires 1 is fixed to the front end portion of each printing lever 4. Each of the printing levers 4 is disposed so as to be rotatable around the rear end portion **4*a* thereof, with the front end portion 4*b* functioning to drive each of the printing wires 1. A coil spring 5 serving as a return spring is fitted in a recess 2*a* provided in the guide support frame 2 and resiliently contacts a portion 4*c* of each of the printing levers 4** so as to apply a return force to each printing lever in the backward direction.

A plurality of electromagnetic driving devices 6 for driving each of the printing levers 4 each comprises a U-shaped core body 7 made of a magnetic material and a drive coil 8 wound around a core element **7*a*. Yoke plates 9, 10 and 11 are laminated on the rear end surface of the external side wall 7*b* of the core body 7 which are coupled together by means of a fastening means such as a screw (not illustrated) which passes through a yoke-retaining frame 12. A retaining spring 13 is fixed in the center of the front of the yoke-retaining frame 12. The retaining spring 13 has at its center portion a ring-shaped portion 13***a* from which a plurality of spring members 13*b* radially extend along the printing levers 4. The rear end portion 4*a* which serves as a supporting point for each of the printing levers 4 is pressed against the yoke plate 9 by the front end portion of each of the spring members 13*b*.

Figure 2:
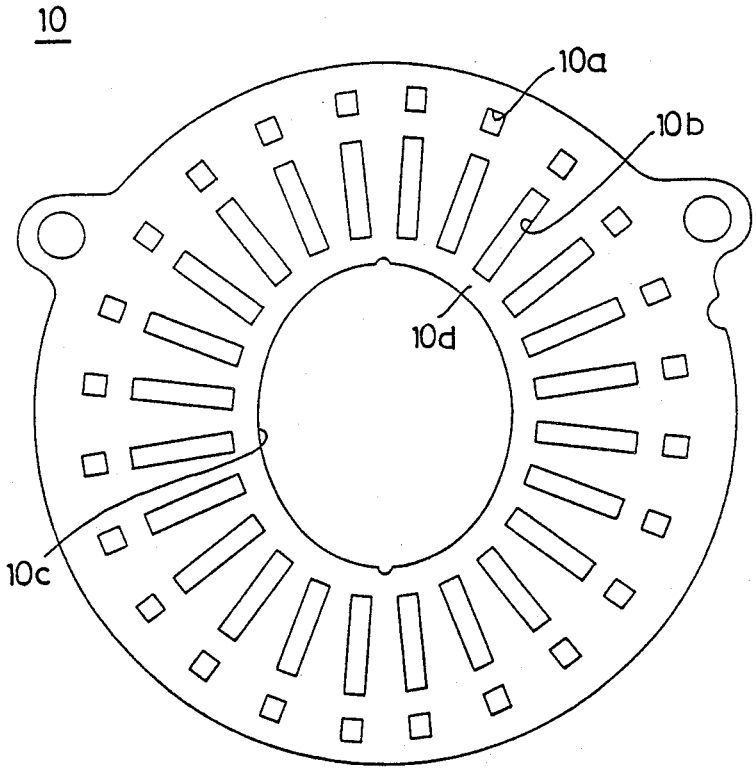
Figure 3:
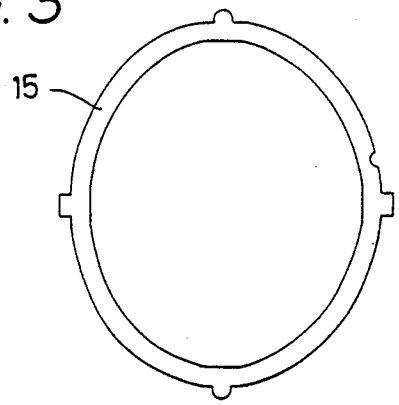

The yoke plate 10 laminated on the rear side of the yoke plate 9 has a shape as shown in FIG. 2. In the yoke plate 10, grooves 10*a* in which the supporting points in the rear end portions of the printing levers 4 are respectively inserted are formed along the external periphery thereof, and elongated grooves 10*b* in which the movable yoke portions 4*d* of the printing levers 4 are inserted are formed inside the grooves 10*a*. Reference numeral 10*c* denotes a central hole, a stopper portion 10*d* being integrally formed between the elongated grooves 10*b* and the central hole 10*c*. The stopper portion 10*d* has on its rear surface a stopper plate 15 shown in FIG. 3 made of a material such as a polyimide having a high durability, and they are integrated to constitute a stopper means.

The stopper means functions to stop the rotation of each of the printing levers 4 by contacting a part 4*e* thereof when each of the printing levers 4 is driven during a printing operation. The stopper means is so set up that the part 4*e* of each of the printing levers contacts the stopper plate 15 before the movable yoke portions 4*d* respectively strike against the core elements 7*a*. Consequently, the movable yoke portions 4*d* do not respectively adhere to the core elements 7*a*.

Figure 4:
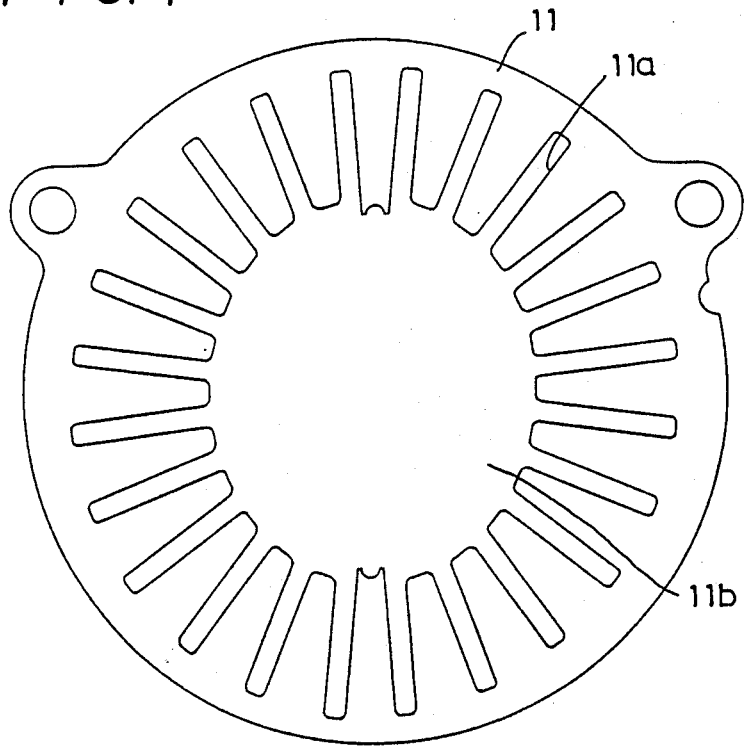

The yoke plate 11 laminated on the rear side of the yoke plate 10 has, as shown in FIG. 4, elongated grooves 11*a* each having substantially the same form as that obtained by connecting each groove 10*a* and each elongated groove 10*b*. The grooves 11*a* are so formed as to communicate with the central hole 11*b*. Reference numeral 16 denotes a stopper for establishing a rest position for the printing levers 4.

In the above-described structure, when no current is applied to the driving coil 8, each of the printing levers 4 is separated from the core member 7*a* of the core body 7, as shown by the solid lines in FIG. 1, and each of the printing elements 1 is at the standby position at which it is held by the return force of the coil spring 5 and contacts the stopper 16. When a printing signal is received by the driving coil 8, the core body 7 is magnetized so that the movable yoke portion 4*d* of each of the printing levers 4 is attracted by the core element 7*a*. Each printing lever 4 is rotated around the supporting point at the rear end portion 4*a* thereof. The part 4*e* of each of the printing levers 4 contacts the stopper plate 15 bonded to the stopper portion 10*d* just before each movable yoke portion 4*d* would otherwise contact the core element 7*a*, i.e., in a position wherein each movable yoke portion 4*d* opposes each core element 7*a* with a small gap therebetween, and each printing lever 4 cannot be further rotated. The rotation of each printing lever 4 causes its front end portion 4*b* to advance, and a printing force is supplied to the printing elements 1 from the respective electromagnetic driving devices 6 through the respective printing levers 4, whereby each printing element 1 moves forwardly for printing.

After printing has been completed, each of the printing levers 4 is moved backwardly by being subjected to the return force of the return spring 5 because no attractive force is exerted on each of the printing levers 4 from each core body 7. However, since there is a small gap between each movable yoke portion 4*d* and each core element 7*a*, the return of each printing lever 4 is immediately started and the lever is rapidly returned to its initial position because of a relatively weak attractive force between the respective movable yoke portions 4*d* and the respective core elements 7*a* as compared to the force existing if the respective movable yoke portions 4*d* and the respective core elements 7*a* were in contact with each other.

Figure 5:
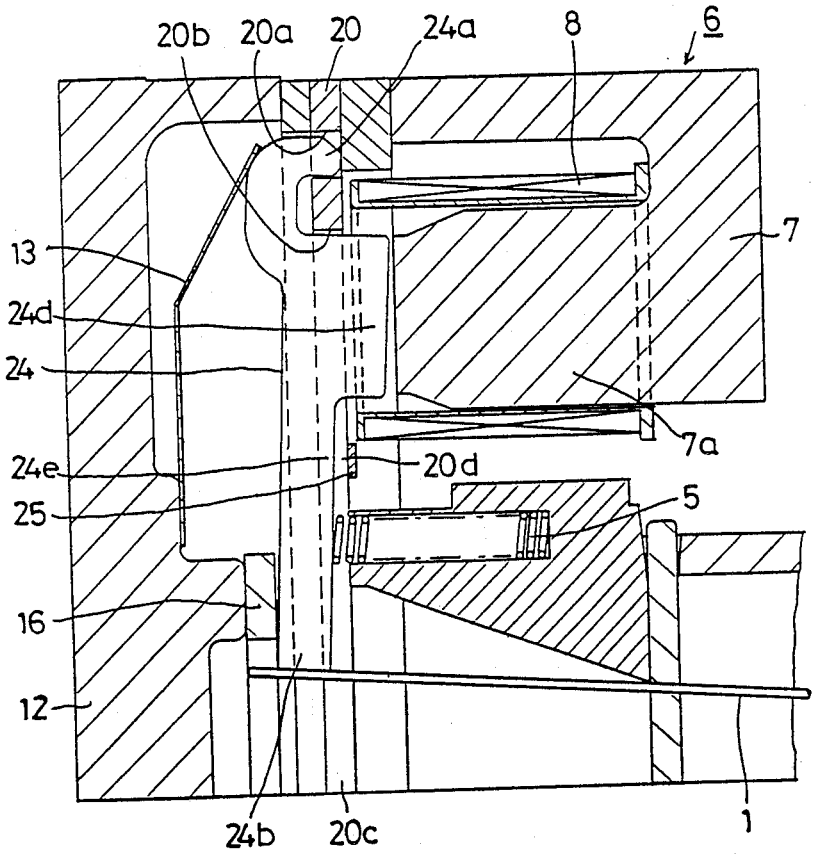
Figure 6:
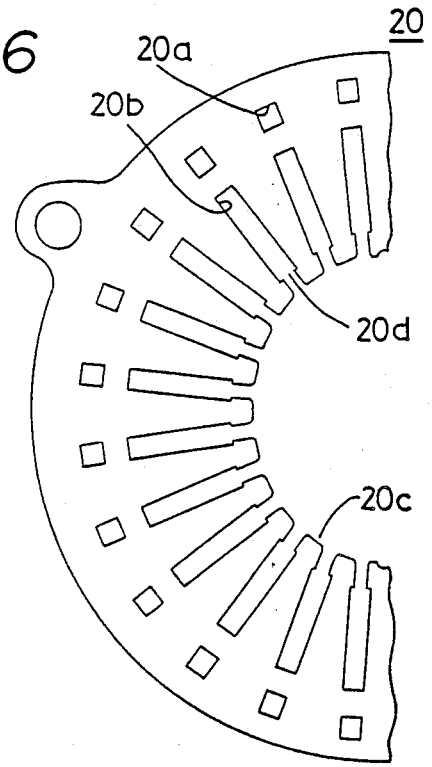
Figure 7:
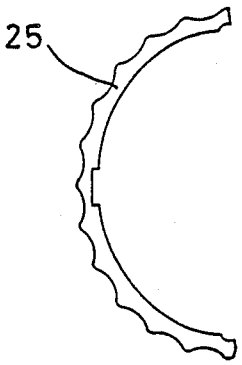

FIG. 5 shows another embodiment in which the yoke plate 10 shown in FIG. 1 is replaced by a yoke plate 20. The yoke plate 20 has a shape as shown in FIG. 6. Grooves 20*a* in which the supporting points in the rear end portions 24*a* of printing levers 24 are inserted are formed in a portion near the peripheral portion thereof, and apertures 20*b* in which the movable portions 24*d* of the printing levers 24 are inserted are formed inside the grooves 20*a* so as to communicate with a center hole 20*c*. A stopper plate 25, which is formed as a separate member having a shape as shown in FIG. 7 and which constitutes a stopper means, is affixed to the front side at the boundary portion between the apertures 20*b* and the center hole 20*c*. The stopper plate 25 is made of a material with a high level of hardness.

When each of the printing levers 24 is driven during a printing operation, a part 24*e* of each printing lever 24 contacts the stopper plate 25 before each movable yoke portion 24*d* collides with each core element 7*a* in the same manner as in the embodiment shown in FIG. 1 so that further rotation of each printing lever 24 is restricted. The other members which are substantially the same as those shown in FIG. 1 are denoted by the same reference numerals.

As described above, according to the present invention, as the movable yoke portion of each printing lever does not contact and thus does not adhere to the corresponding core element when each printing lever is driven for printing, each printing lever can be returned by a relatively small return force, and thus it takes little time to start the return movement of each printing lever which is consequently rapidly returned. Although it is very difficult to equalize the attractive force exerted on all the printing levers, the present invention allows no contact between each movable yoke portion and each core element and thus enables a reduction in the deviation between the respective attractive forces and the differences of the return movements of the respective printing levers. It is also possible to reduce the necessary return force and thus to drive the printing levers by less energy than in conventional printing heads.

In addition, there is an advantage in that the structure in which a stopper portion formed as a separate member is affixed to the yoke plate enables the stopper portion to be disposed at an appropriate position without being affected by error in the thickness of the yoke plate, and also facilitates setting of the position of the stopper portion with which each of the printing levers comes into contact.

What we claim is:

1. A printing head comprising:

a plurality of printing levers, each of said printing levers having a front end portion, a yoke portion and a rear end portion, said printing levers being rotatable about said rear end portions, said front end portions being operable to drive printing elements;

electromagnetic drive means including a plurality of core elements and plurality of coils operable to individually drive said printing levers in a driving direction so as to apply a printing force to said printing elements, said yoke portions each being juxtaposed to a core element;

resilient means applying a return force to each of said printing levers in a return direction opposite to said driving direction;

a yoke plate having first grooves in which said rear end portion of each of said printing levers are disposed and second grooves for receiving said yoke portions of said printing levers; and means for preventing contact between each of said yoke portions of said printing levers and said core elements;

said contact preventing means being located so as to contact said printing levers at a point remote from said yoke portions and said core elements and avoid the presence of any structure between said core elements and the yoke portions;

said contact preventing means being a stopper fixed to said yoke plate.

2. A printing head according to claim 1, wherein said resilient means comprises a plurality of return springs each of which acts on a respective printing lever.

3. A printing head according to claim 1, wherein said yoke portion is integral with said printing lever, said electromagnetic drive means comprising a core element, said stopper member precluding contact between said core element and said yoke portion.

4. A printing head according to claim 1, wherein each of said electromagnetic means has a magnetizable core body which attracts said yoke portion of said printing levers, said stopper member precluding contact between said core body and said yoke portion of said printing lever.

5. A printing head according to claim 1, wherein said printing levers are rotatable between a printing position and a return position, said electromagnetic drive means being operable to move said printing levers to said printing position, said electromagnetic drive means having a magnetizable core body which attracts said yoke portion of said printing levers, said stopper member preventing said yoke portion of said printing levers from contacting said core body when said printing levers are in said printing position.

6. A printing head according to claim 1, wherein said stopper member is made of polyimide.

* * * * *